US006629390B2

(12) United States Patent
Wood, Jr. et al.

(10) Patent No.: US 6,629,390 B2
(45) **Date of Patent: *Oct. 7, 2003**

(54) ENVIRONMENTAL PROTECTION AND DETECTION SYSTEM

(75) Inventors: James E. Wood, Jr., Dallas, TX (US); John E. Sepich, Camarillo, CA (US)

(73) Assignee: Argent Industrial, L.P., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/408,608

(22) Filed: Apr. 7, 2003

(65) Prior Publication Data

US 2003/0163973 A1 Sep. 4, 2003

Related U.S. Application Data

(63) Continuation of application No. 09/480,124, filed on Jan. 10, 2000, now Pat. No. 6,543,189.

(51) Int. Cl.[7] ..... E04B 1/92

(52) U.S. Cl. ..... 52/169.14; 405/129.85; 405/129.7; 454/909; 52/900; 52/302.1; 52/302.3

(58) Field of Search ..... 405/129.85, 129.7, 405/129.45, 129.5, 129.57, 129.6, 129.75; 454/341, 345, 909; 52/408, 169.14, 302.1, 302.3, 900

(56) References Cited

U.S. PATENT DOCUMENTS 4,538,386 A * 9/1985 DiCello ..... 52/302.3
4,682,492 A * 7/1987 Green ..... 405/54
4,696,599 A * 9/1987 Rakoczynski et al. ..... 210/170
4,773,309 A * 9/1988 Walters ..... 237/46
4,810,131 A * 3/1989 Turner ..... 210/170
4,849,360 A * 7/1989 Norris et al. ..... 210/150
4,858,521 A * 8/1989 Heh ..... 175/62
4,938,124 A * 7/1990 Garza ..... 454/339
5,054,252 A * 10/1991 Newman ..... 52/169.14
5,083,500 A * 1/1992 Francis et al. ..... 454/341
5,107,642 A * 4/1992 Mogstad ..... 52/169.5
5,277,003 A * 1/1994 Myers ..... 52/169.5
5,457,270 A * 10/1995 Hildebrand et al. ..... 134/104.2
5,551,797 A * 9/1996 Sanford ..... 405/229
5,740,638 A * 4/1998 Shepherd, III ..... 52/169.5
5,771,643 A * 6/1998 Parker ..... 52/169.5
5,885,026 A * 3/1999 Hwang ..... 210/901
6,065,901 A * 5/2000 Stevens et al. ..... 405/128.15
6,102,617 A * 8/2000 Hampton ..... 405/129.5
6,293,120 B1 * 9/2001 Hashimoto ..... 165/45

FOREIGN PATENT DOCUMENTS

GB 2257782 A * 1/1993 ..... F24F/7/04

* cited by examiner

*Primary Examiner*—Anthony Knight
*Assistant Examiner*—Katherine Mitchell
(74) *Attorney, Agent, or Firm*—Michael A. O'Neil

(57) ABSTRACT

An environmental protection and detection system includes a vapor and gas impervious barrier extending beneath at least part of the area of an enclosure to prevent fluids leaked or spilled within the enclosure for flowing downwardly into the underlying soil and ground water and to prevent vapors and gases emanating from sources beneath the enclosure from percolating upwardly into the enclosure. Lengths of perforated pipe are positioned above the barrier and are connected to points outside the enclosure for use in detecting and removing contaminants leaked or spilled within the enclosure. Lengths of perforated pipe are positioned beneath the barrier and are vented to the atmosphere for preventing accumulations of fluids emanating from sources beneath the enclosure.

1 Claim, 5 Drawing Sheets

ENVIRONMENTAL PROTECTION AND DETECTION SYSTEM

This application is a continuation of U.S. Ser. No. 09/480,124 filed Jan. 10, 2000 now U.S. Pat No. 6,543,189.

TECHNICAL FIELD

This invention relates generally to the protection of the subsurface under the floors of buildings and other enclosures from environmental contamination, and more particularly to a system for containing contaminants originating within the building and facilitating the detection and removal thereof and for venting contaminants emanating from sources beneath the building.

BACKGROUND AND SUMMARY OF THE INVENTION

Buildings and similar enclosures require environmental protection for at least two reasons. First, leaks, spills, etc. occurring within the building can seep downwardly, eventually causing contamination of the underlying soil and ground water. Depending upon the magnitude and duration of the problem, either of these conditions can lead to the condemnation of the building or other enclosure. Second, gases and liquids emanating from sources located beneath the building can percolate upwardly leading to contamination of the building with odorous, poisonous, and/or flammable substances.

The present invention comprises an environmental protection and detection system which overcomes the foregoing and other problems which have long since characterized the prior art. In accordance with the broader aspects of the invention, a barrier layer is disposed beneath the floor of the building or other enclosure. The barrier extends continuously across the entire length and width of the enclosure or portions thereof. The barrier prevents leaks, spills, etc. originating within the building from seeping into the underlying soil and ground water. The barrier also prevents gases and liquids emanating from sources beneath the building from entering the building.

A layer of fill may be distributed over the top of the barrier and beneath the floor of the building. Above the barrier, there is disposed a plurality of perforated pipe sections each connected to an individual outlet member. The perforated pipe sections situated above the barrier are arranged in a predetermined pattern to facilitate the detection and removal of materials which had been leaked, spilled, etc. within the building and which have penetrated through the floor thereof.

Sections of perforated pipe are disposed beneath the barrier in a predetermined array. In this manner gases and liquids emanating from sources beneath the building are received within the perforated pipe sections. The perforated pipe sections are connected to vent risers which extend upwardly to discharge ports located above the top of the building. In this manner contaminants emanating from sources beneath the building are vented to the atmosphere and are prevented from entering the building.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 1:
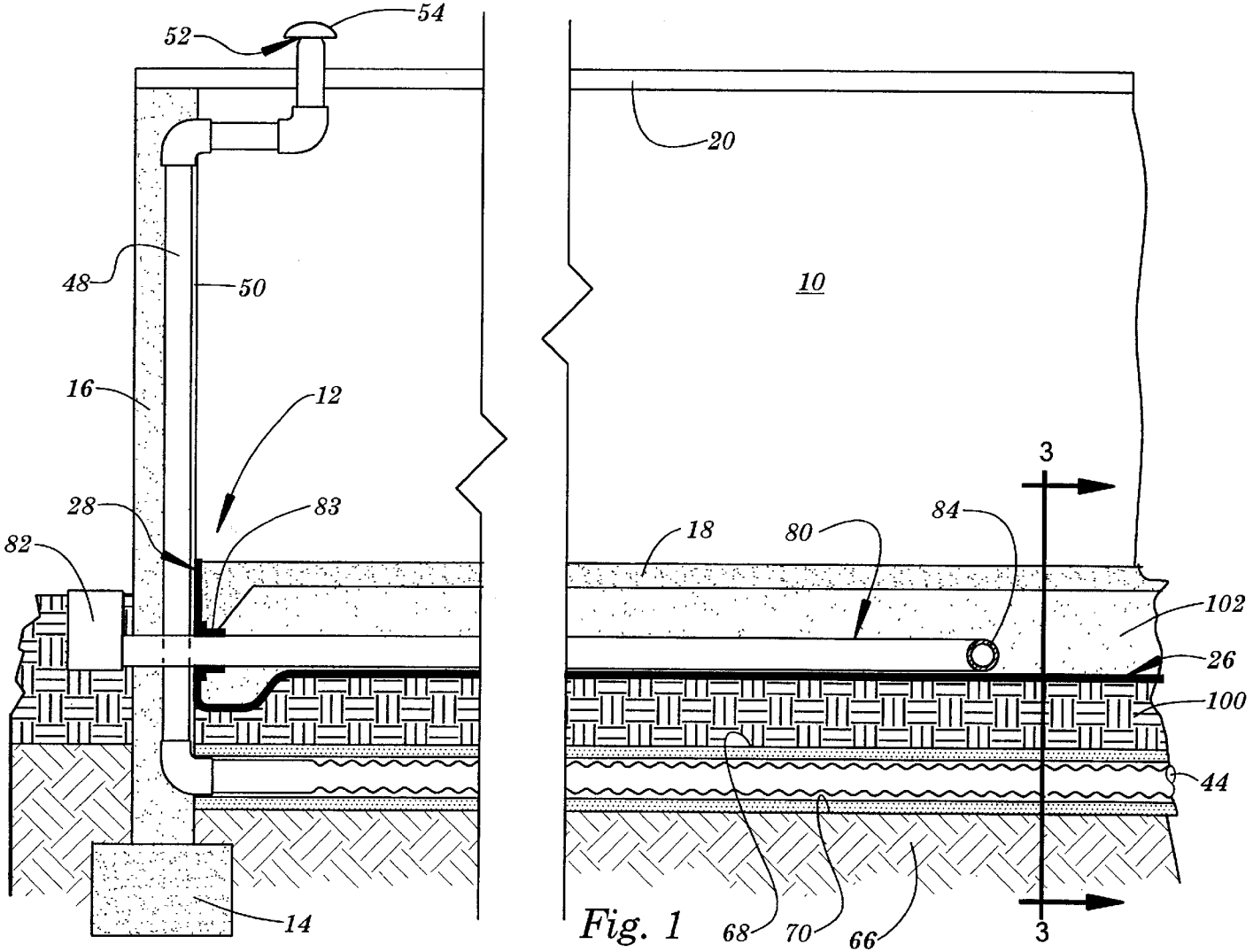
FIG. 1 is a vertical sectional view of a building equipped with the environmental protection and detection system of the present invention.

Referring now to the Drawings, and particularly to FIG. 1 thereof, there is shown a building 10 incorporating an environmental protection and detection system 12 constructed in accordance with the present invention. The building 10 comprises a foundation 14, walls 16 extending upwardly from the foundation 14, a floor 18 extending between the walls 16, and a roof 20 overlying the foundation 14. It will be understood that the component parts of the building 10 as shown in FIG. 1, et seq. are illustrative only, and that the present invention is applicable to buildings constructed in accordance with a wide variety of building techniques now known or hereafter developed. Those skilled in the art will further appreciate and understand that the present invention is readily adapted for use in conjunction with enclosures other than buildings.

The environmental protection and detection system 12 of the present invention includes a barrier 26 extending beneath the floor 18 of the building 10. The barrier 26 may extend across the entire length and width of the building 10 or selected portions thereof. The end portions 28 of the barrier 26 extend upwardly between the floor 18 and the walls 16 comprising the building 10 thereby forming a seal between the floor 18 and the walls 16.

The barrier 26 is preferably formed from high density polyethylene (HDPE) having a thickness of at least 40 mils. As will be appreciated by those skilled in the art, other materials may be utilized in the practice of the invention for the construction of the barrier 26. The only requirement is that the barrier 26 is effective to prevent leaks, spills, etc. originating within the building from seeping downwardly into the underlying soil and ground water and to prevent gases and liquids emanating from sources beneath the building from percolating upwardly into the interior of the building.

If it is necessary that a pipe or conduit penetrates the barrier 26 from the subsurface, a boot formed from the same material as the barrier is constructed around the vertical portion of the pipe or conduit allowing for an overlap of the barrier at point of penetration. The boot is welded or otherwise secured to the pipe or conduit and to the barrier 26 with no gaps.

Figure 3:
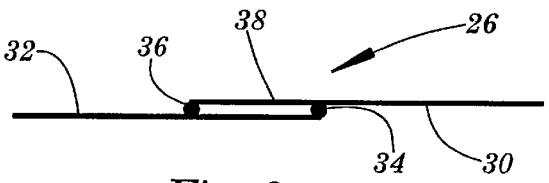
FIG. 3 is a sectional view taken generally along the line 3—3 in FIG. 1.

In certain circumstances the dimensions of the building 10 may be larger than the dimensions of the sheets of the material which are used to form the barrier 26. In such instances adjacent sheets of materials are joined in the manner illustrated in FIG. 3. Sheets of material 30 and 32 are joined together by parallel welds 34 and 36 thereby forming a pocket 38 between the welds 34 and 36. After the welds 34 and 36 are completed, the pocket 38 is filled with compressed air to test the welds 34 and 36 against leakage. Other joint constructions between adjacent sheets of barrier material can also be used.

Figure 4:
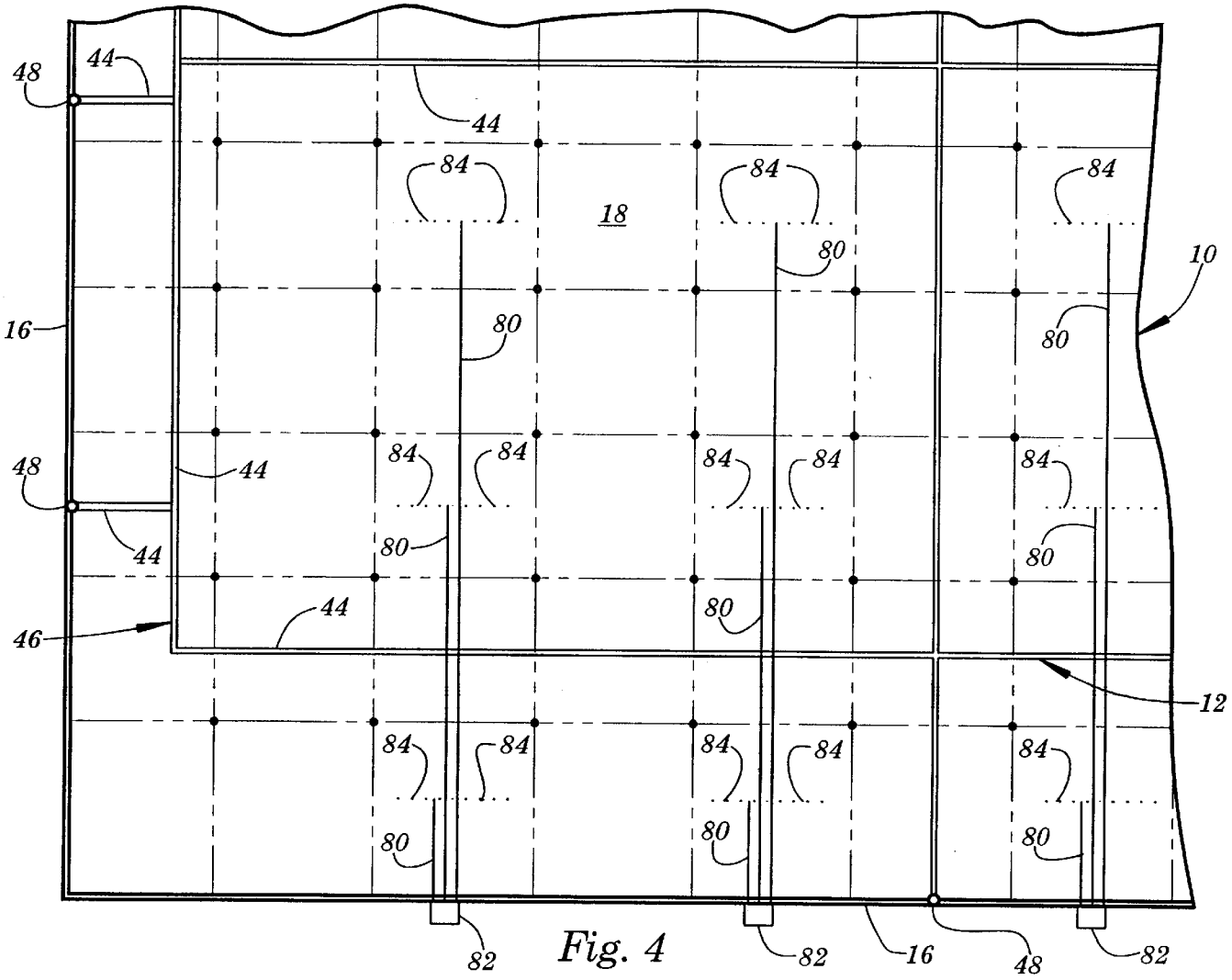
FIG. 4 is a partial plan view of the building of FIG. 1 further illustrating the environmental protection and detection system thereof.

Referring again to FIG. 1, the environmental protection and detection system 12 comprises a plurality of lengths of perforated or slotted pipe 44. As is best shown in FIG. 4, the lengths of perforated pipe 44 are interconnected to form a grid 46 which underlies the entirety of the floor 18 of the building 10. The lengths of perforated pipe 44 extend to vent risers 48 which extend upwardly through channels 50 formed in the wall 16 of the building 10 (FIG. 1). As will be appreciated by those skilled in the art, the vent risers 48 need not extend through channels, but can be suitably located in accordance with the requirements of particular applications of the invention. The upper end of each vent riser 48 extends through the roof 20 of the building to a vent 52 which is open to the atmosphere. Each vent 52 is provided with a rain cap 54.

Figure 2:
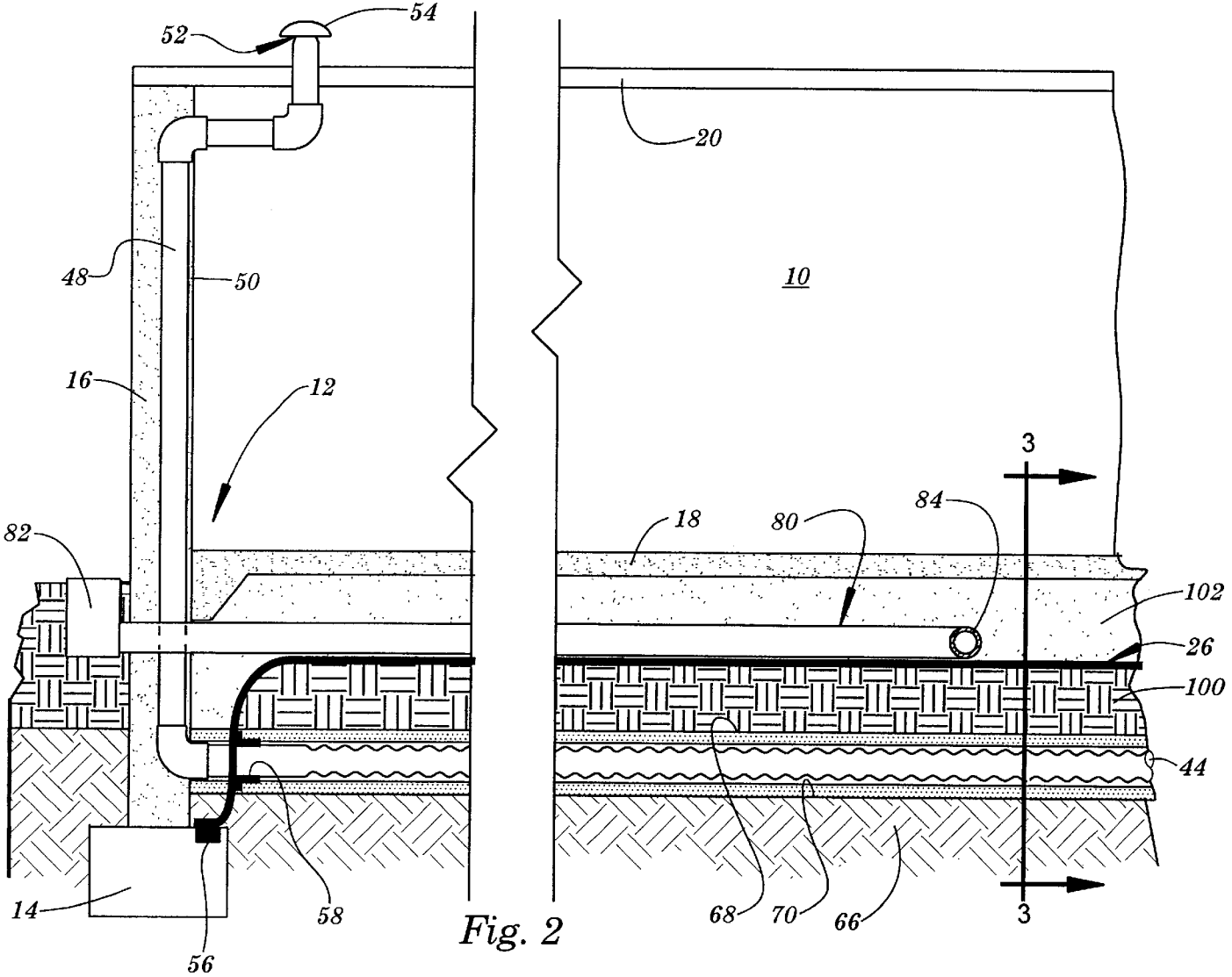
FIG. 2 is a view similar to FIG. 1 showing an alternative embodiment of the invention.

Referring to FIG. 2, there is shown an alternative method of securing the edge of the barrier 26. The foundation 14 is provided with a continuous channel 56 formed from high density polyethylene (HDPE). The edge of barrier 26 is welded to the HDPE channel 56. A boot 58 formed from the same material as the barrier 26 is formed around the intersection of the barrier 26 and the pipe 44 and is welded or otherwise secured to the barrier 26 and to the pipe 44 with no gaps.

Figure 5:
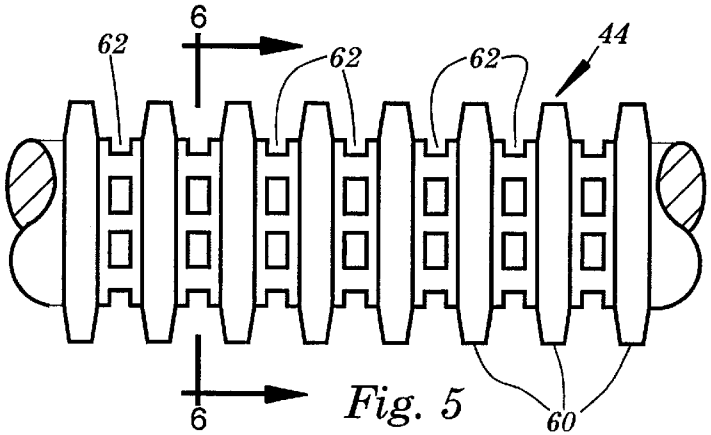
FIG. 5 is an enlarged side view of one of the component parts of the environmental protection and detection system of FIG. 1.
Figure 6:
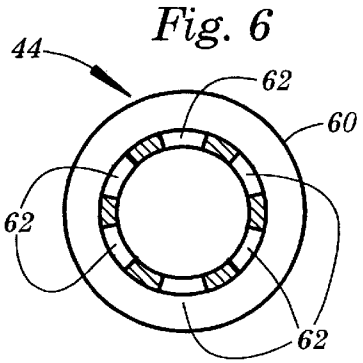
FIG. 6 is a sectional view taken generally along the line 6—6 of FIG. 5.

The construction of the lengths of perforated pipe 44 is further illustrated in FIGS. 5 and 6. The perforated pipe 44 comprises a plastic material and includes spaced apart ribs 60. Apertures 62 are formed in the perforated pipe 44 between the ribs 60. The perforated pipe is of the type identified in the industry as corrugated HDPE (high density polyethylene), and is provided in rolls which are uncoiled as the perforated pipe 44 is installed. Other types of perforated pipe can also be used in the practice of the invention.

Figure 7:
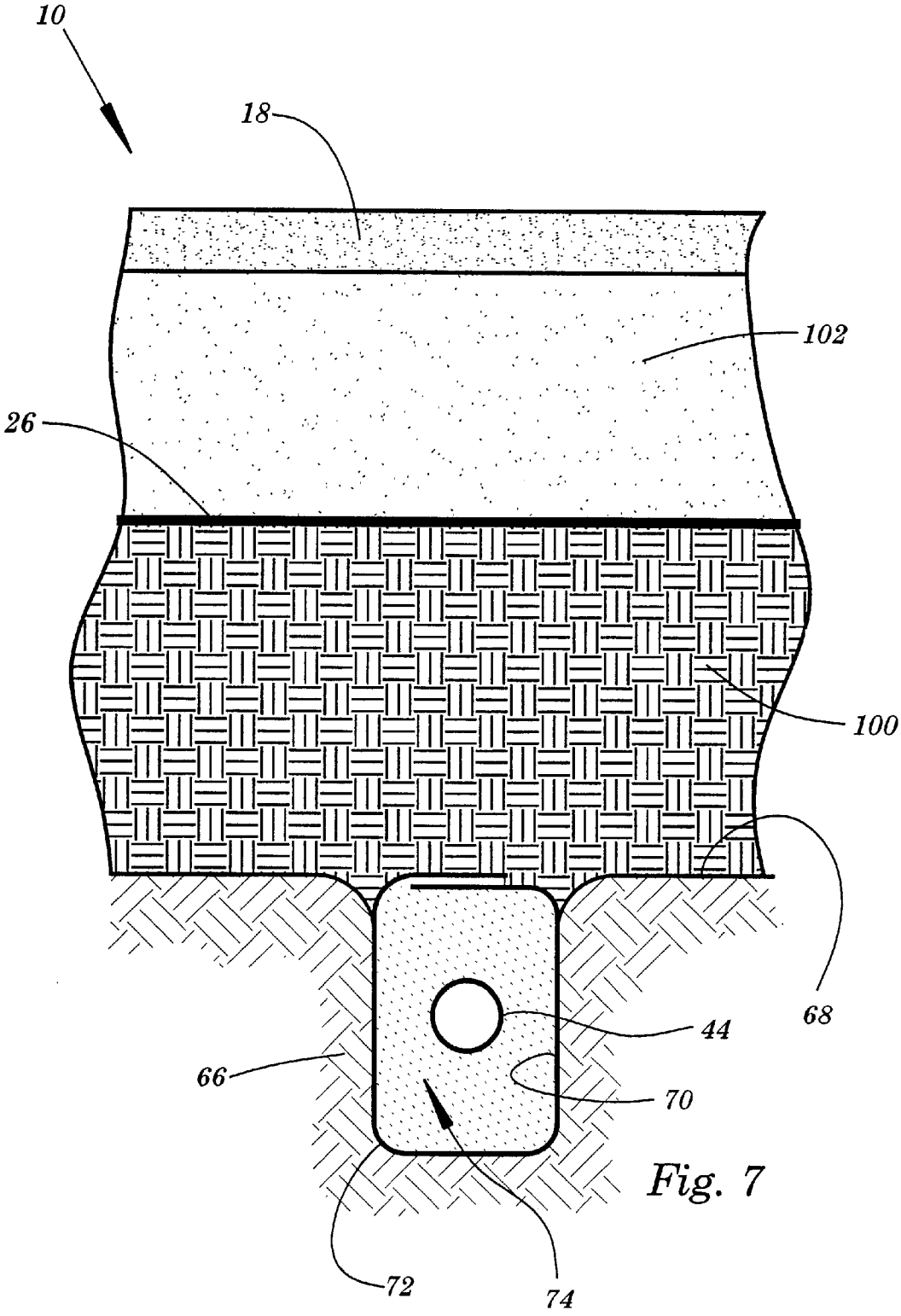
FIG. 7 is an illustration of the installation of the component part of FIG. 5.

The installation of the perforated pipe 44 is further illustrated in FIG. 7. The subsoil 66 underlying what will become the floor of the building 10 is scraped to provide a relatively smooth upper surface 68. A trench 70 is formed in the undisturbed subsoil 66. The trench 70 is lined with a fabric layer 72 to prevent the soil from contaminating the interior of the slotted pipe 44. The fabric layer 72 is sufficiently permeable to allow gases and vapors to pass therethrough while at the same time being impermeable to solids, particularly soil. After the fabric layer 72 is installed, the trench 70 is filled with pea gravel or similar self compacting aggregate to a depth of approximately one half of the trench, The slotted pipe 44 is then installed on top of the aggregate. The remainder of the trench is then filled with pea gravel or similar aggregate, after which the fabric layer 72 is folded over the top of the aggregate. In this manner it is assured that the slotted pipe 44 will remain open to the entry of gases and vapors and will not become clogged with soil.

Referring to FIGS. 1, 2, and 4, the environmental protection and detection system 12 further includes a plurality of contamination detection and removal apparatus 80. The contamination detection and removal apparatus 80 extends from boxes 82 located outside the walls 16 of the building 10 and accessible from the exterior surface. A boot 83 formed from the same material as the barrier 26 is secured around each apparatus 80 and overlaps the barrier 26. The boot is secured by welding with no gaps.

The contamination detection and removal apparatus 80 define a matrix wherein the apparatus 80 are spaced at predetermined intervals based on the porosity of the subfloor material to facilitate monitoring of the entire area beneath the floor 18 of the building 10, and it necessary, the removal of contaminants from particular locations beneath the floor 18.

Figure 8:
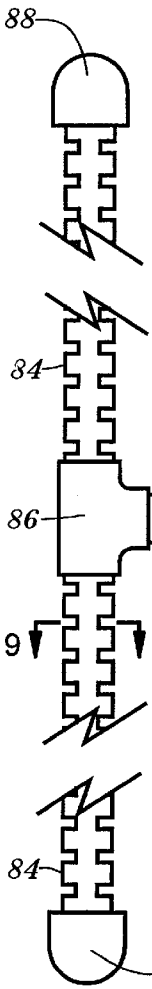
FIG. 8 is an enlarged top view of another component part of the environmental protection and detection system of FIG. 1.
Figure 9:
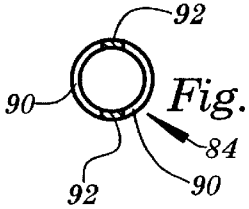
FIG. 9 is a sectional view taken generally along the line 9—9 of FIG. 8.

The construction of the contamination monitoring and removal apparatus 80 is further illustrated in FIGS. 8 and 9. Sections of slotted pipe 84 extend outwardly from a tee connector 86 to end caps 88. As is shown in FIG. 9, the slotted pipe sections 84 comprise openings 90 connected by webs 92. A solid pipe section 94 extends from the tee connector 86 to a fitting 96 adapted to connect the slotted pipe sections 84 to monitoring probes and/or a vacuum apparatus.

The procedure for installing the environmental protection and detection system 12 of the present invention will be best understood by reference to FIG. 1. The subsoil 66 is first worked to provide a relatively flat, relatively smooth top surface 68. The trench 70 is then formed in accordance with the desired pattern of the perforated pipes 44. The perforated pipes 44 are then installed as illustrated in FIG. 7 and described hereandabove in conjunction therewith.

After the perforated pipes 44 have been installed, a first layer of fill 100 may be deposited over the subsoil 66 and is suitably compacted. If used, the fill material is selected so as to be entirely free of rocks and debris to assure that the barrier 26 will not be penetrated. At this point the walls 16 are constructed on top of the foundation 14 and the vent risers 48 are connected to the perforated pipes 44.

Next after the installation process is the installation of the barrier 26. If the sheets comprising the barrier 26 are not large enough to fill the entire area defined by the wall 16, adjacent sheets are welded as illustrated in FIG. 2. The contamination detection and removal apparatus 80 are next installed over the barrier 26 and are extended through apertures which have been formed in the wall 16. If necessary, a second fill layer 102 may be installed over the barrier 26 and the. contamination detection and removal apparatus 80 and is suitably compacted. The floor 18 is then installed over the second fill layer 102 with the end portions 28 of the barrier 26 extending between the walls 16 and the floor 18 to form a seal there between.

In the operation of the environmental protection and detection system 12 of the present invention, fluids percolating upwardly from sources located beneath the building 10 are trapped by the barrier 26 and therefore cannot enter the building 10. However, fluids percolating upwardly passed through the subsoil 66, the fabric layer 72, and the aggregate 74, and thereupon enter the perforated pipe 44.

The perforated pipe sections 44 are vented to the atmosphere through the vent risers 48 and the vents 52. Therefore, changes in atmospheric pressure result in pressure changes within the perforated pipes 44. This results in a pumping action which causes vapors and/or gases received within the perforated pipes 44 to be pumped upwardly through the vent risers 48 and vented to the atmosphere through the vents 52. This result is highly advantageous in preventing accumulations of troublesome and potentially dangerous fluids beneath the barrier 26.

Regardless of the construction of the floor 18 of the building 10, fluids leaked or spilled within the building 10 may pass through the floor 18 thereof and into the fill layer 102 situated on top of the barrier 26. In any such event the barrier 26 prevents such fluids from flowing further downwardly through the fill 100, into the subsoil 66, and eventually contaminating soil and ground water within the soil.

The contamination detection and removal apparatus 80 are utilized to monitor the content of the fill layer 102 and to effect removal of any contaminants therefrom in the event that fluids from the building 10 pass through the floor 18 thereof and into the fill layer 102. In one application of the invention, environmental detection devices are connected to the solid pipes 94 and are used to withdraw air from the subfloor material. The withdrawn air carries traces of contaminants which are detected by the environmental detection devices. In another application of the invention, a vacuum pump is connected to the fitting 96 and is utilized to withdraw vapors and/or gases from the fill layer 102 through the perforated pipes 104. The vapors and/or gases thus withdrawn from the fill layer 102 may be analyzed using various well known techniques and apparatus.

Assuming that the foregoing testing procedures reveal contamination within the fill layer 102, additional testing may be performed in order to ascertain the exact region of the fill layer 102 in which the contamination has occurred. Thereafter, vacuum pumps may be connected to the fittings 96 of various contamination detection and removal apparatus 80 whereby the contaminant is withdrawn from beneath the floor 18 of the building 10 for appropriate disposal. If the viscosity of the contaminant prevents direct removal thereof, the apparatus 80 may be utilized to initially direct solvents into the fill layer 102. After the solvent has dissolved the contaminant, vacuum pumps are connected to the fittings 96 of appropriate apparatus 80 to remove the solvent and the contaminant dissolved therein from the fill 102. Another approach is the utilization of the apparatus 80 to discharge a contaminant neutralizing agent into the area of the fill layer 102 which is contaminated.

Although preferred embodiments of the invention have been illustrated in the accompanying drawings and described in the foregoing detailed description, it will be understood that the invention is not limited to the embodiments disclosed but is capable of numerous rearrangements, modifications, and substitutions of parts and elements without departing from the spirit of the invention.

What is claimed is:

1. In combination:

a structure extending over a predetermined area and an environmental protection and detection system for said enclosed structure comprising:

a fluid impermeable layer positioned beneath the enclosed structure and extending under the entire area thereof for preventing gases emanating from sources beneath the enclosed structure from percolating upwardly into the enclosed structure and for preventing liquids leaked or spilled within the enclosed structure from flowing downwardly into the underlying soil and ground water;

a first length of perforated pipe situated beneath the fluid impermeable layer for receiving gases emanating from sources located beneath the enclosed structure;

means for venting the first length of perforated pipe to the atmosphere;

a second length of perforated pipe situated above the fluid impermeable layer for use in the detecting and removing liquids spilled or leaked within the enclosed structure; and means for connecting the interior of the second length of perforated pipe to a location outside the enclosed structure.

* * * * *